US009543675B1

(12) United States Patent
Takenaga et al.

(10) Patent No.: US 9,543,675 B1
(45) Date of Patent: Jan. 10, 2017

(54) BOARD-TO-BOARD CONNECTOR ASSEMBLY AND CONNECTOR

(71) Applicant: Japan Aviation Electronics, Limited, Tokyo (JP)

(72) Inventors: Yuichi Takenaga, Tokyo (JP); Hiroaki Obikane, Tokyo (JP); Takayuki Nishimura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/082,155

(22) Filed: Mar. 28, 2016

(30) Foreign Application Priority Data

Jul. 1, 2015 (JP) ..... 2015-132627

(51) Int. Cl.
*H01R 12/00* (2006.01)
*H01R 12/71* (2011.01)
*H01R 13/635* (2006.01)

(52) U.S. Cl.
CPC ..... *H01R 12/716* (2013.01); *H01R 13/635* (2013.01)

(58) Field of Classification Search
USPC ..... 439/65, 74
See application file for complete search history.

(56) References Cited

U.S. PATENT DOCUMENTS 5,975,916 A * 11/1999 Okura ..... H01R 12/716 439/660
7,410,364 B2 * 8/2008 Kishi ..... H01R 12/716 439/566
7,585,185 B2 * 9/2009 Obikane ..... H01R 13/65802 439/108
7,717,719 B2 * 5/2010 Miyazaki ..... H01R 12/57 439/74
7,722,408 B2 * 5/2010 Miyazaki ..... H01R 13/516 439/570
7,845,987 B2 * 12/2010 Yamada ..... H01R 12/716 439/680
8,182,272 B2 * 5/2012 Ooi ..... H01R 12/716 439/660
8,272,881 B2 * 9/2012 Miyazaki ..... H01R 13/20 439/345
8,469,722 B2 * 6/2013 Huang ..... H01R 12/716 439/74
8,562,379 B2 * 10/2013 Miyazaki ..... H01R 12/716 439/660

(Continued)

FOREIGN PATENT DOCUMENTS

JP 2014-170726 A 9/2014

*Primary Examiner* — Tho D Ta
(74) *Attorney, Agent, or Firm* — Collard & Roe, P.C.

(57) ABSTRACT

In a board-to-board connector assembly, a plug-side power contact includes a first flat surface portion having a plate-like shape, a second flat surface portion having a plate-like shape and being opposed to a first part of the first flat surface portion and a power-contact-side connection portion connecting the first and second flat surface portions to each other. The first flat surface portion has the first part facing in parallel to the second flat surface portion and a second part or an upper end portion other than the first part. The first part includes a thinned portion having a shape recessed more deeply than a surface of the upper end portion and having a smaller thickness along the third direction than a thickness of the upper end portion.

16 Claims, 16 Drawing Sheets

(56) References Cited

U.S. PATENT DOCUMENTS

| | | | | |
|---|---|---|---|---|
| 8,992,233 | B2 * | 3/2015 | Miyazaki | H01R 12/707 439/74 |
| 8,992,234 | B2 * | 3/2015 | Yoshioka | H01R 12/716 439/74 |
| 9,225,086 | B2 * | 12/2015 | Takeuchi | H01R 12/716 |
| 9,331,406 | B2 * | 5/2016 | Watanabe | H01R 12/7011 |
| 2013/0137307 | A1 * | 5/2013 | Huang | H01R 12/716 439/660 |
| 2013/0344710 | A1 * | 12/2013 | Sasaki | H01R 12/71 439/65 |
| 2014/0220830 | A1 | 8/2014 | Kubo et al. | |

* cited by examiner

BOARD-TO-BOARD CONNECTOR ASSEMBLY AND CONNECTOR

This application is based upon and claims the benefit of priority from Japanese Patent Application No. 2015-132627, filed on Jul. 1, 2015, the disclosure of which is incorporated herein in its entirety by reference.

TECHNICAL FIELD

This invention relates to a board-to-board connector assembly and a connector.

BACKGROUND ART

Hitherto, as a connector for connecting surfaces of boards to each other, a board-to-board connector assembly has been used.

The board-to-board connector assembly includes a set of a plug connector and a receptacle connector. The plug connector is inserted into the receptacle connector, and contacts (conductive terminals) of the connectors are brought into contact with each other. Thus, the plug connector and the receptacle connector are electrically connected to each other (JP-A-2014-170726, which is hereinafter referred to as Patent Document 1).

This configuration is described with reference to FIG. 27 and FIG. 28.

As illustrated in FIG. 27, a receptacle connector 201 disclosed in Patent Document 1 includes a housing 210 having an insulating property, conductive terminals 230 arrayed in the housing 210, and solder pegs 250 each arranged at a vicinity of each end of the housing 210.

Further, as illustrated in FIG. 28, a plug connector 300 disclosed in Patent Document 1 includes a housing 310, and conductive terminals 330 arrayed in two rows in the housing 310.

SUMMARY OF THE INVENTION

Problem to be Solved by the Invention

Here, among the contacts, a contact, which is configured to allow a signal current to flow therethrough (signal contact), is only required to allow a small current capable of transmitting a signal to flow therethrough. Further, in recent years, downsizing of contacts has been strongly demanded. Consequently, the width of the signal contact becomes smaller and smaller.

On the other hand, when conduction of a power current through the connector is also required, the signal contact cannot be used as a power contact because the signal contact has an extremely small width.

In this context, in order to use the signal contact as the power contact, hitherto, a thickness of the contact has been increased, thereby increasing a current carrying capacity.

However, when the thickness of the contact is increased, a resin flows poorly in insert molding employed for forming the housing at the time of manufacture of the connector. As a result, there is a problem in that the manufacture is difficult.

That is, in order to increase the current carrying capacity, the thickness of the contact may be increased. However, there exists such a trade-off that moldability of the housing is deteriorated when the thickness of the contact is increased.

This invention has been made in view of the above-mentioned problem, and has an object to provide a board-to-board connector assembly capable of ensuring both a current carrying capacity and moldability.

Means for Solving the Problem

In order to achieve the object mentioned above, according to a first aspect of the present invention, a board-to-board connector assembly, comprising: a receptacle connector comprising: a receptacle-side housing comprising: an insular portion having long sides along a first direction and extending along a second direction orthogonal to the first direction; and receptacle-side long wall portions formed so that a recessed portion is formed between the insular portion and each of the receptacle-side long wall portions along a third direction orthogonal to both of the first direction and the second direction; a receptacle-side signal contact comprising a contact portion, the receptacle-side signal contact being retained in the receptacle-side housing so that the contact portion is exposed to an inside of the recessed portion; and a receptacle-side power contact, which is retained in the receptacle-side housing so as to be arrayed together with the receptacle-side signal contact along the first direction; and a plug connector comprising: a plug-side housing comprising a projecting portion to be inserted into the recessed portion; a plug-side signal contact, which is retained in the plug-side housing so as to be exposed to an outside of the projecting portion; and a plug-side power contact, which is retained in the plug-side housing so as to be exposed to the outside of the projecting portion, and is to be brought into contact with the receptacle-side power contact, the plug-side power contact comprising: a first flat surface portion having a plate-like shape and being parallel to the first direction and the second direction; a second flat surface portion having a plate-like shape and being opposed to a part of the first flat surface portion through intermediation of a component of the plug-side housing; and a power-contact-side connection portion formed in parallel to the third direction and the first direction and configured to connect the first flat surface portion and the second flat surface portion to each other, at least one of the first flat surface portion and the second flat surface portion comprising: a stepped portion between a surface opposed in parallel to a surface of another one of the first flat surface portion and the second flat surface portion, and a surface except for the surface opposed in parallel to the surface of the another one of the first flat surface portion and the second flat surface portion; and a thinned portion that corresponds to a portion having the surface opposed in parallel to the surface of the another one of the first flat surface portion and the second flat surface portion, and has a smaller thickness along the third direction than a thickness of a portion having the surface except for the surface opposed in parallel to the surface of the another one of the first flat surface portion and the second flat surface portion is provided.

The plug-side signal contact may comprise: a third flat surface portion having a plate-like shape and being parallel to the first direction and the second direction; a fourth flat surface portion having a plate-like shape and being opposed to a part of the third flat surface portion through intermediation of the component of the plug-side housing; and a signal-contact-side connection portion formed in parallel to the third direction and the first direction and configured to connect the third flat surface portion and the fourth flat surface portion to each other, and wherein a distance along the third direction between an inner side of the third flat surface portion and an inner side of the fourth flat surface portion is equal to a distance along the third direction between the first flat surface portion and the second flat surface portion at a position between an inner side of the thinned portion and an inner side of one of the first flat surface portion and the second flat surface portion opposed to the thinned portion.

According to the first aspect, the plug-side power contact may be arranged on an end portion side of the plug-side housing along the first direction with respect to the plug-side signal contact, and the receptacle-side power contact may be arranged on an end portion side of the receptacle-side housing along the first direction with respect to the receptacle-side signal contact.

According to the first aspect, the plug-side housing may further comprise a plug-side reinforcing portion arranged on the end portion side of the plug-side housing along the first direction with respect to the plug-side power contact, and the receptacle-side housing may further comprise a receptacle-side reinforcing portion arranged on the end portion side of the receptacle-side housing along the first direction with respect to the receptacle-side power contact.

According to the first aspect, the plug-side reinforcing portion and the receptacle-side reinforcing portion may be to be used for conduction of power through contact with each other under a state in which the plug connector and the receptacle connector are fitted to each other.

According to the first aspect, the plug-side reinforcing portion may be arranged on each end of the plug-side housing along the first direction, and the receptacle-side reinforcing portion may be arranged on each end of the receptacle-side housing along the first direction.

According to the first aspect, the plug-side power contacts may be equally arranged at four positions on the plug-side housing, and the receptacle-side power contacts may be equally arranged at four positions on the receptacle-side housing.

According to the first aspect, the plug-side power contact may be wider than the plug-side signal contact along the first direction, and the receptacle-side power contact may be wider than the receptacle-side signal contact along the first direction.

According to a second aspect of the present invention, a connector, comprising: a plug-side housing, which has long sides along a first direction, the plug-side housing comprising a plug-side fitting portion extending along a second direction orthogonal to the first direction; a plug-side signal contact, which is retained in the plug-side housing so as to be exposed to an outside of the plug-side fitting portion; and a plug-side power contact, which is retained in the plug-side housing so as to be exposed to the outside of the plug-side fitting portion, the plug-side power contact comprising: a first flat surface portion having a plate-like shape and being parallel to the first direction and the second direction; a second flat surface portion having a plate-like shape and being opposed to a part of the first flat surface portion through intermediation of a component of the plug-side housing; and a power-contact-side connection portion formed in parallel to the first direction and a third direction orthogonal to the first direction and the second direction, and configured to connect the first flat surface portion and the second flat surface portion to each other, at least one of the first flat surface portion and the second flat surface portion comprising: a stepped portion between a surface opposed in parallel to a surface of another one of the first flat surface portion and the second flat surface portion, and a surface except for the surface opposed in parallel to the surface of the another one of the first flat surface portion and the second flat surface portion; and a thinned portion that corresponds to a portion having the surface opposed in parallel to the surface of the another one of the first flat surface portion and the second flat surface portion, and has a smaller thickness along the third direction than a thickness of a portion having the surface except for the surface opposed in parallel to the surface of the another one of the first flat surface portion and the second flat surface portion is provided.

According to the second aspect, the plug-side signal contact may comprise: a third flat surface portion having a plate-like shape and being parallel to the first direction and the second direction; a fourth flat surface portion having a plate-like shape and being opposed to a part of the third flat surface portion through intermediation of the component of the plug-side housing; and a signal-contact-side connection portion formed in parallel to the third direction and the first direction and configured to connect the third flat surface portion and the fourth flat surface portion to each other, and a distance along the third direction between an inner side of the third flat surface portion and an inner side of the fourth flat surface portion may be equal to a distance along the third direction between the first flat surface portion and the second flat surface portion at a position between an inner side of the thinned portion and an inner side of one of the first flat surface portion and the second flat surface portion opposed to the thinned portion.

According to the second aspect, the plug-side power contact may be arranged on an end portion side of the plug-side housing along the first direction with respect to the plug-side signal contact.

According to the second aspect, the plug-side housing may further comprise a plug-side reinforcing portion arranged on the end portion side of the plug-side housing along the first direction with respect to the plug-side power contact.

According to the second aspect, the plug-side reinforcing portion may be to be used for conduction of power.

According to the second aspect, the plug-side reinforcing portion may be arranged on each end of the plug-side housing along the first direction.

According to the second aspect, the plug-side power contacts may be equally arranged at four positions on the plug-side housing.

According to the second aspect, the plug-side power contact may be wider than the plug-side signal contact along the first direction.

Effect of the Invention

According to this invention, it is possible to provide the board-to-board connector assembly capable of ensuring both the current carrying capacity and the moldability.

MODE FOR CARRYING OUT THE INVENTION

Now, an exemplary embodiment of this invention is described in detail with reference to the drawings.

Figure 1:
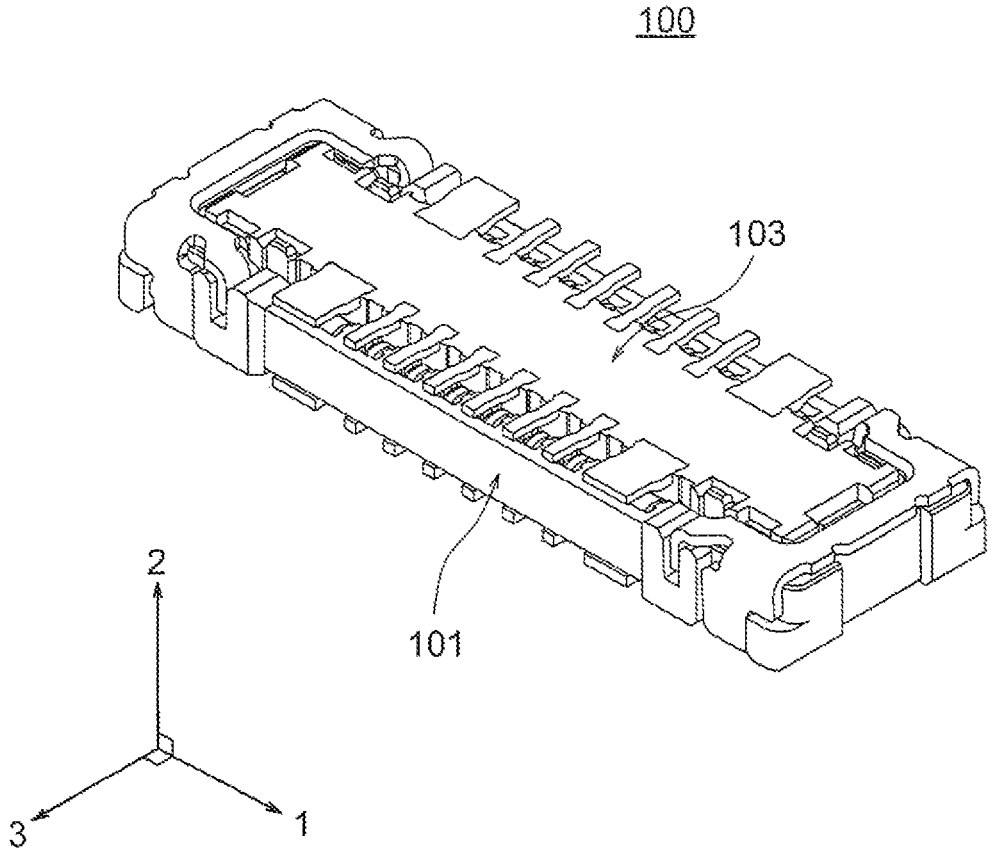
FIG. 1 is a perspective view of a board-to-board connector assembly 100.

Note that, in the following description, as illustrated in FIG. 1, directions of each component are indicated through use of an orthogonal coordinate system. A first direction 1, a second direction 2 orthogonal to the first direction 1, and a third direction 3 orthogonal to the first direction 1 and the second direction 2 are defined as three directions in the orthogonal coordinate system.

Further, in the first direction 1, the second direction 2, and the third direction 3, orientations indicated by the arrows of FIG. 1 are defined as "positive orientations", and orientations opposite to the orientations indicated by the arrows of FIG. 1 are defined as "negative orientations".

First, with reference to FIG. 1 to FIG. 9, description is made of overviews of a board-to-board connector assembly 100 according to this embodiment and connectors constructing the board-to-board connector assembly 100.

Here, as the board-to-board connector assembly 100, a combination of a receptacle connector 101 and a plug connector 103 is exemplified.

Figure 2:
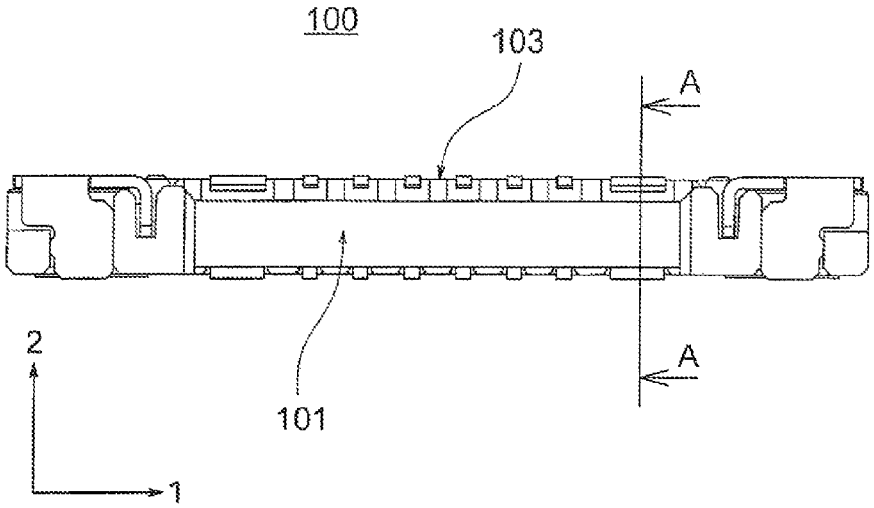
FIG. 2 is a side view of FIG. 1.
Figure 3:
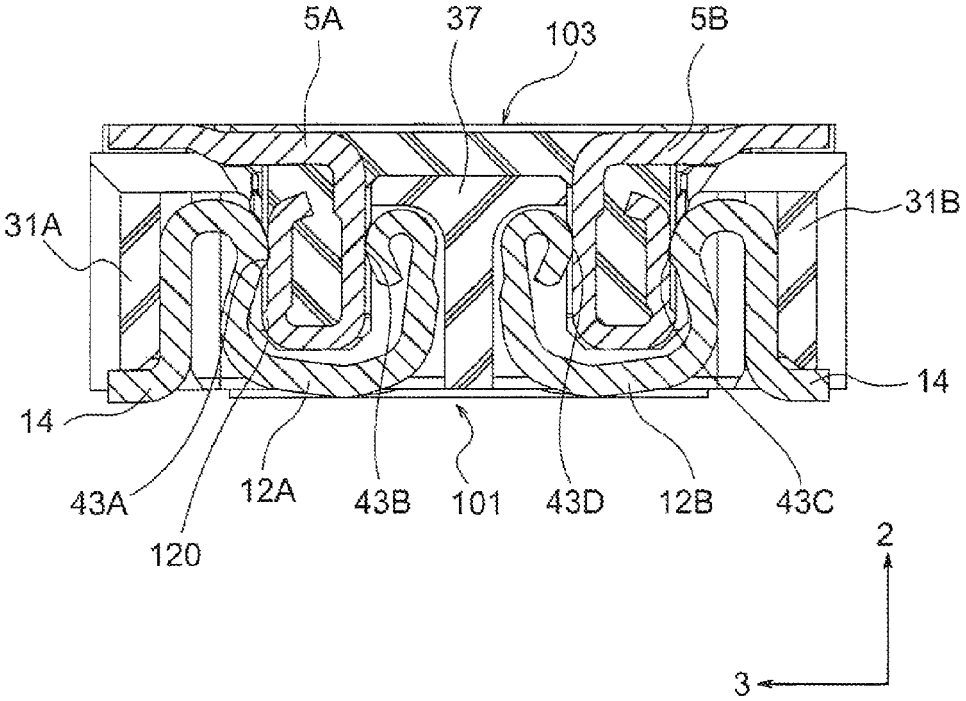
FIG. 3 is a cross-sectional view taken along the line A-A of FIG. 2.

As illustrated in FIG. 1 to FIG. 3, the board-to-board connector assembly 100 includes the receptacle connector 101, and the plug connector 103 to be connected to the receptacle connector 101.

Figure 4:
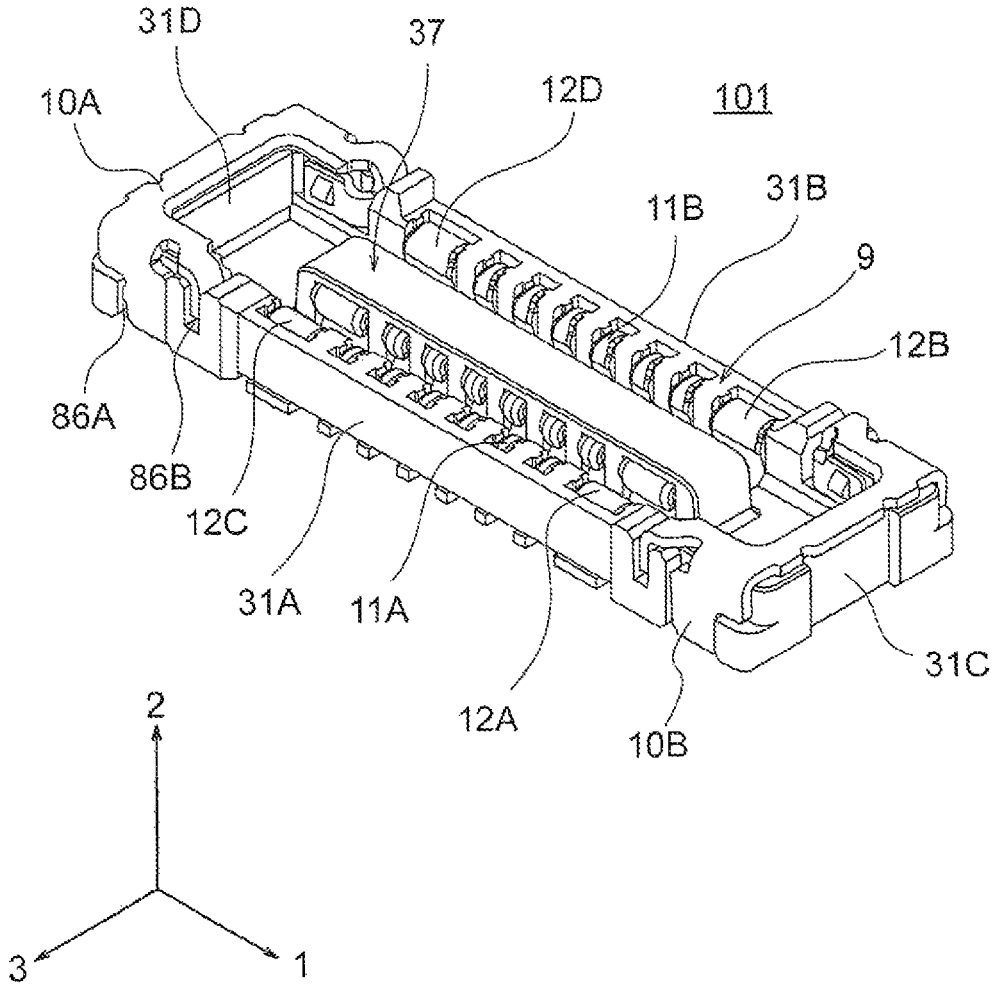
FIG. 4 is a perspective view of a receptacle connector 101.
Figure 5:
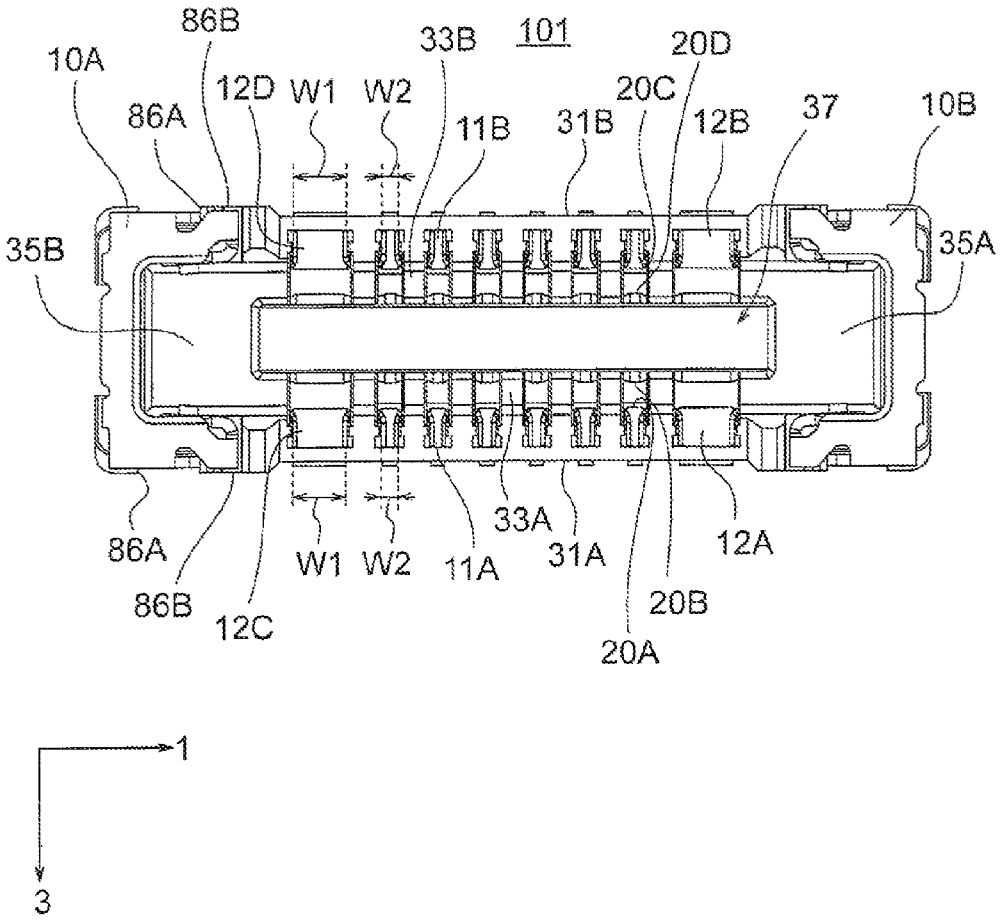
FIG. 5 is a plan view of the receptacle connector 101.

As illustrated in FIG. 4 and FIG. 5, the receptacle connector 101 includes a receptacle-side housing 9 having a rectangular and thick-plate-like shape in plan view, receptacle-side signal contacts 11A and 11B being contacts arranged at predetermined pitches in a longitudinal direction of the receptacle-side housing 9 (in a direction parallel to the first direction 1), four receptacle-side power contacts 12A, 12B, 12C, and 12D, which are arranged on longitudinal end portion sides of the receptacle-side housing 9 with respect to the receptacle-side signal contacts 11A and 11B, and are brought into contact with plug-side power contacts 5A, 5B, 5C, and 5D (see FIG. 6) when fitted thereto, and receptacle-side reinforcing portions 10A and 10B arranged on the longitudinal end portion sides of the receptacle-side housing 9 with respect to the receptacle-side power contacts 12A, 12B, 12C, and 12D (arranged at both longitudinal ends of the receptacle-side housing 9 in this case).

As illustrated in FIG. 6 to FIG. 9, the plug connector 103 includes a plug-side housing 5 being a housing having a rectangular shape in plan view, plug-side signal contacts 7A and 7B being contacts arranged at predetermined pitches in a longitudinal direction of the plug-side housing 5, the plug-side power contacts 5A, 5B, 5C, and 5D, which are arranged on longitudinal end portion sides of the plug-side housing 5 with respect to the plug-side signal contacts 7A and 7B, and are equally arranged at four positions close to four corners of edge portions of the plug-side housing 5, and plug-side reinforcing portions 141A and 141B arranged on the longitudinal end portion sides of the plug-side housing 5 with respect to the plug-side power contacts 5A, 5B, 5C, and 5D (arranged at both longitudinal ends of the plug-side housing 5 in this case).

Next, structure of each component constructing the receptacle connector 101 is described in more detail with reference to FIG. 3 to FIG. 5 and FIG. 13 to FIG. 16.

As illustrated in FIG. 4 and FIG. 5, the receptacle-side housing 9 includes an insular portion 37 having long sides along the first direction 1 and extending in (the positive orientation of) the second direction 2 orthogonal to the first direction 1, and receptacle-side long wall portions 31A and 31B formed so that a recessed portion 33A is formed between the insular portion 37 and the receptacle-side long wall portion 31A and a recessed portion 33B is formed between the insular portion 37 and the receptacle-side long wall portion 31B along the third direction 3 orthogonal both to the first direction 1 and the second direction 2.

More specifically, as illustrated in FIG. 4 and FIG. 5, the longitudinal direction of the receptacle-side housing 9 of the receptacle connector 101 corresponds to the pitch direction of the receptacle-side signal contacts 11A and 11B. The receptacle-side housing 9 includes the pair of opposed receptacle-side long wall portions 31A and 31B, and a pair of opposed receptacle-side short wall portions 31C and 31D each coupling end portions of the pair of receptacle-side long wall portions 31A and 31B to each other. Note that, in this case, the receptacle-side long wall portions 31A and 31B correspond to long sides of a rectangle, and the receptacle-side short wall portions 31C and 31D correspond to short sides of the rectangle.

As illustrated in FIG. 4 and FIG. 5, the recessed portions 33A and 33B, into which the plug connector 103 is inserted, are formed in an upper surface of the receptacle-side housing 9 along the long sides of the rectangle. The receptacle-side signal contacts 11A and 11B are arranged astride the recessed portions 33A and 33B at predetermined pitches in the longitudinal direction. The receptacle-side power contacts 12A, 12B, 12C, and 12D are arranged at end portions of the receptacle-side housing 9 along the first direction 1.

Note that, end portions of the recessed portions 33A and 33B are coupled by coupling recessed portions 35A and 35B formed along the short sides of the rectangle. As a whole, the recessed portions 33A and 33B and the coupling recessed portions 35A and 35B exhibit a frame-like shape conforming to the plug-side housing 5 of the plug connector 103 in plan view. A center portion of the receptacle-side housing 9 constructs the insular portion 37.

In addition, the plate-like receptacle-side reinforcing portions 10A and 10B, which are made of a conductive material such as metal, are arranged on the receptacle-side short wall portions 31D and 31C, respectively.

As illustrated in FIG. 3, the receptacle-side power contacts 12A and 12B are plate-like members each having a C-shaped cross-section. Both ends of the C-shaped cross-section are respectively arranged on the receptacle-side long wall portion 31A or 31B and the insular portion 37 so as to be exposed to an inside of the recessed portion 33A or 33B.

Further, the both ends of the C-shaped cross-section of the receptacle-side power contact 12A include contact portions 43A and 43B to be brought into contact with the plug-side power contact 5A described later, and the both ends of the C-shaped cross-section of the receptacle-side power contact 12B include contact portions 43C and 43D to be brought into contact with the plug-side power contact 58B described later.

Further, the end portion of the C-shaped cross-section of the receptacle-side power contact 12A on the contact portion 43A side has a shape projected in the negative orientation of the second direction 2, and includes a mounting portion 14 to be connected to a pad of a board (not shown). The end portion of the C-shaped cross-section of the receptacle-side power contact 12B on the contact portion 43C side has a shape projected in the negative orientation of the second direction 2, and includes a mounting portion 14 to be connected to a pad of a board (not shown).

Note that, the receptacle-side power contacts 12C and 12D have the same shapes as those of the receptacle-side power contacts 12A and 12B. Thus, description thereof is omitted.

The receptacle-side signal contacts 11A and 11B have the same cross-sectional shapes as those of the receptacle-side power contacts 12A, 12B, 12C, and 12D.

That is, each of the receptacle-side signal contacts 11A (11B) is a plate-like member having a C-shaped cross-section. Both ends of the C-shaped cross-section include contact portions 20A and 20B (20C and 20D) to be brought into contact with the plug-side signal contact 7A (7B) described later (see FIG. 5).

As illustrated in FIG. 5, a width W1 (maximum width) of each of the receptacle-side power contacts 12A to 12D along the first direction 1 is larger than a width W2 (maximum width) of each of the receptacle-side signal contacts 11A and 11B along the first direction 1.

As illustrated in FIG. 13 to FIG. 16, the receptacle-side reinforcing portion 10A includes a receptacle-side reinforcing body portion 81 having an elongated plate-like shape extending along the receptacle-side short wall portion 31D (see FIG. 4) and along the third direction 3, a pair of receptacle-side reinforcing leg portions 83 each formed so as to protrude in the negative orientation of the second direction 2 from an end portion of the receptacle-side reinforcing body portion 81 along the third direction 3, and receptacle-side reinforcing coupling portions 85A and 85B each having a plate-like shape, protruding in the negative orientation of the second direction 2 from a side surface of an end portion of the receptacle-side reinforcing body portion 81 along the third direction 3 on the positive orientation side of the first direction 1, and further protruding in the negative orientation of the first direction 1. The receptacle-side reinforcing coupling portions 85A and 85B are to be engaged with the plug-side reinforcing portion.

Each of the receptacle-side reinforcing leg portions 83 includes a protrusion 87, which protrudes in the negative orientation of the first direction 1 and is to be used when the receptacle-side reinforcing portion 10A is press-fitted to the receptacle-side short wall portion 31D.

Further, the receptacle-side reinforcing coupling portions 85A and 85B respectively include protrusions 87A and 87B, which protrude in the negative orientation and the positive orientation of the third direction 3, respectively, and are to be engaged with the plug-side reinforcing portion.

The receptacle-side reinforcing portion 10A is retained in the receptacle-side housing 9 in such a manner that the receptacle-side reinforcing leg portions 83 and the receptacle-side reinforcing coupling portions 85A and 85B are inserted into groove portions 86A and 86B (see FIG. 4 and FIG. 5) formed in each of the receptacle-side long wall portions 31A and 31B of the receptacle-side housing.

Note that, the receptacle-side reinforcing portion 10B has the same structure as that of the receptacle-side reinforcing portion 10A. Accordingly, description thereof is omitted.

The structure of each component constructing the receptacle connector 101 is described above.

Next, structure of each component constructing the plug connector 103 is described with reference to FIG. 6 to FIG. 12 and FIG. 17 to FIG. 25.

As illustrated in FIG. 6 to FIG. 9, the plug-side housing 5 includes a pair of plug-side fitting portions 15A and 15B having an elongated plate-like shape and being projecting portions that are formed in parallel to each other and are to be inserted into the recessed portions 33A and 33B of the receptacle connector 101 (see FIG. 5), and plug-side coupling portions 15C and 15D formed so as to couple end portions of the plug-side fitting portions 15A and 15B to each other. The plug-side fitting portions 15A and 15B and the plug-side coupling portions 15C and 15D exhibit a frame-like shape in plan view. Note that, in FIG. 6 to FIG. 9, the plug-side fitting portions 15A and 15B correspond to long sides of a rectangle extending along the first direction 1, and also correspond to portions extending in (the negative orientation of) the second direction 2. The plug-side coupling portions 15C and 15D correspond to short sides of the rectangle extending along the third direction 3.

As illustrated in FIG. 10 and FIG. 17 to FIG. 19, the plug-side power contact 5A includes a first flat surface portion 91 having a plate-like shape and being parallel to the first direction 1 and the second direction 2, a second flat surface portion 93 having a plate-like shape and being opposed to a part of the first flat surface portion 91 through intermediation of a component (made of, for example, a resin in this case) of the plug-side housing 5, and a power-contact-side connection portion 95 formed in parallel to the third direction 3 and the first direction 1 and configured to connect end portions of the first flat surface portion 91 and the second flat surface portion 93 in the negative orientation of the second direction 2.

Further, an end portion of the first flat surface portion 91 in the positive orientation of the second direction 2 includes an upper end portion 99 (FIG. 19) that is not opposed in parallel to the second flat surface portion 93. At the upper end portion 99, there is formed a plate-like mounting portion 127 that protrudes in the positive orientation of the third direction 3 and is to be mounted to a board (not shown).

At least one of the first flat surface portion 91 and the second flat surface portion 93 includes a stepped portion 115 between a surface opposed in parallel to one surface of another one of the first flat surface portion 91 and the second flat surface portion 93, and a surface except for the surface opposed in parallel to the one surface of the another one of the first flat surface portion 91 and the second flat surface portion 93, and includes a thinned portion 113 that corresponds to a portion having the surface opposed in parallel to the one surface of the another one of the first flat surface portion 91 and the second flat surface portion 93, and has a smaller thickness along the third direction 3 than a thickness of the upper end portion 99 having the surface except for the surface opposed in parallel to the one surface of the another one of the first flat surface portion 91 and the second flat surface portion 93.

Specifically, the thinned portion 113 of the first flat surface portion 91, which is opposed in parallel to the second flat surface portion 93, is coupled to the upper end portion 99 through intermediation of the stepped portion 115.

In addition, in the first flat surface portion 91, a thickness T2 of the thinned portion 113 along the third direction 3 is smaller than a thickness T1 of the upper end portion 99 along the third direction 3.

With this structure, in the plug-side power contact 5A, a distance D2 along the third direction 3 between an inner side of the thinned portion 113 and an inner side of the second flat surface portion 93 is larger than a distance D1 along the third direction 3 between an inner side of the upper end portion 99 and an inner side of the second flat surface portion 93.

With this structure, without enlarging a distance D3 along the third direction 3 between an outer side of the first flat surface portion 91 and an outer side of the second flat surface portion 93, the distance D2 between the inner side of the thinned portion 113 and the inner side of the second flat surface portion 93 can be enlarged.

As a result, when the plug-side power contact 5A is formed on the plug-side housing 5 by insert molding, a resin for forming the plug-side housing 5 can easily flow into a space between the first flat surface portion 91 and the second flat surface portion 93.

On the other hand, in the plug-side power contact 5A, the thickness T1 of the upper end portion 99 along the third direction 3 is larger than the thickness T2 of the thinned portion 113 along the third direction 3. Accordingly, it is possible to prevent reduction in current carrying capacity, which may result from arrangement of the thinned portion 113.

Thus, the plug-side power contact 5A can ensure both the current carrying capacity and moldability.

Note that, on the outer side of the second flat surface portion 93, there is formed a band-like protruding portion 120 protruding in the positive orientation of the third direction 3 and being configured to prevent disengagement when the plug-side power contact is engaged with the contact portion 43A of the receptacle-side power contact 12A or the contact portion 43C of the receptacle-side power contact 12B (see FIG. 3).

Further, the plug-side power contacts 5B, 5C, and 5D have the same structure as that of the plug-side power contact 5A. Accordingly, description thereof is omitted.

Further, the plug-side power contacts 5A, 5B, 5C, and 5D are arranged on end portion sides of the plug-side housing 5 along the arraying direction of the plug-side signal contacts 7A and 7B (first direction 1). Thus, the plug-side power contacts 5A, 5B, 5C, and 5D are arranged on the end portion sides of the plug-side housing 5 along the first direction 1, thereby being capable of easily changing the pitches of the plug-side signal contacts 7A and 7B between the plug-side power contacts 5A and 5C or between the plug-side power contacts 5B and 5D as compared to a case where the plug-side power contacts 5A, 5B, 5C, and 5D are arranged between the plug-side signal contacts 7A or between the plug-side signal contacts 7B. Accordingly, it is possible to prevent reduction in degree of freedom to design the plug-side signal contacts 7A and 7B, which may result from arrangement of the plug-side power contacts 5A, 5B, 5C, and 5D.

Further, the plug-side power contacts 5A, 5B, 5C, and 5D are equally arranged at positions close to the four corners of the plug-side housing 5. Similarly, the receptacle-side power contacts 12A, 12B, 12C, and 12D are equally arranged at positions close to the four corners of the receptacle-side housing 9.

With this structure, the plug-side power contacts 5A, 5B, 5C, and 5D and the receptacle-side power contacts 12A, 12B, 12C, and 12D can be stably fitted to each other.

As illustrated in FIG. 11 and FIG. 20 to FIG. 22, the plug-side signal contact 7A includes a third flat surface portion 121 having a plate-like shape and being parallel to the first direction 1 and the second direction 2, a fourth flat surface portion 123 having a plate-like shape and being opposed to a part of the third flat surface portion 121 through intermediation of a component (made of, for example, a resin in this case) of the plug-side housing 5, and a signal-contact-side connection portion 125 formed in parallel to the third direction 3 and the first direction 1 and configured to connect end portions of the third flat surface portion 121 and the fourth flat surface portion 123 in the negative orientation of the second direction 2.

Further, at an end portion of the third flat surface portion 121 in the positive orientation of the second direction 2, the plate-like mounting portion 127 is formed, which protrudes in the positive orientation of the third direction 3 and is to be mounted to a board (not shown).

In addition, on a flat surface on an outer side (on the positive orientation side of the third direction 3) of the fourth flat surface portion 123, there is formed a band-like protruding portion 129 configured to prevent disengagement when the plug-side signal contact is engaged with the contact portions 20A and 20B of the receptacle-side signal contact 11A or the contact portions 20C and 20D of the receptacle-side signal contact 11B.

The cross-sectional shape of each of the plug-side signal contacts 7A and 7B is similar to the cross-sectional shape of each of the plug-side power contacts 5A, 5B, 5C, and 5D. All of the third flat surface portion 121, the fourth flat surface portion 123, the signal-contact-side connection portion 125, and the mounting portion 127 have the same thickness in a plate thickness direction, and the thickness is equal to the thickness T2 of the thinned portion 113 of the plug-side power contact 5A (see FIG. 22).

Figure 19:
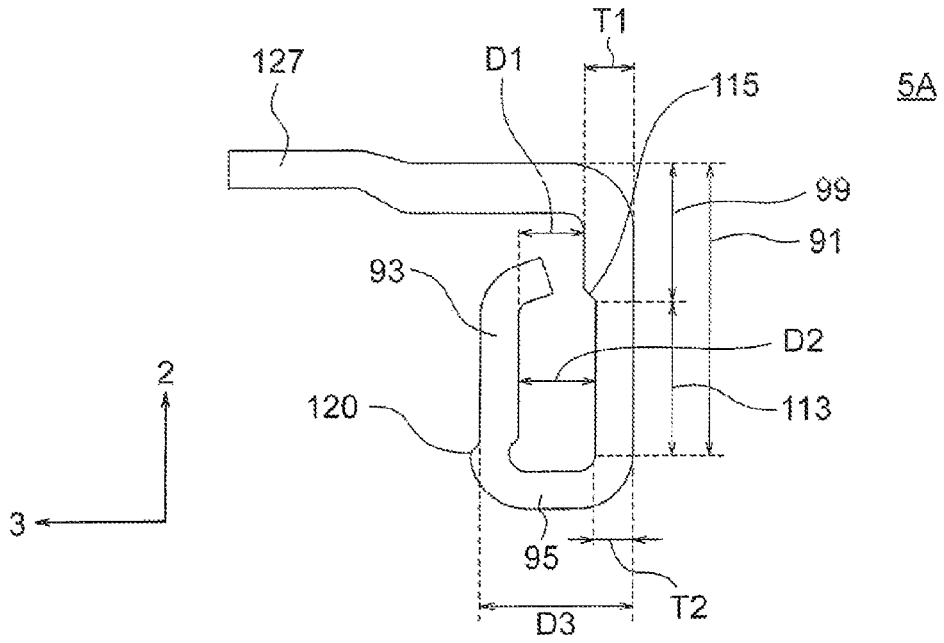
FIG. 19 is a side view of the plug-side power contact 5A.

In addition, it is desired that a distance D4 (FIG. 22) along the third direction 3 between an inner side of the third flat surface portion 121 and an inner side of the fourth flat surface portion 123 be equal to the distance D2 (FIG. 19). The reason is described as follows.

When manufacturing the plug connector 103, for example, under a state in which the plug-side power contacts 5A, 5B, 5C, and 5D and the plug-side signal contacts 7A and 7B are arranged on a die (not shown) so as to establish a predetermined positional relationship, a resin is poured into the die (not shown), and the resin is cured, thereby forming the plug-side housing 5. That is, the plug-side power contacts 5A, 5B, 5C, and 5D and the plug-side signal contacts 7A and 7B are integrated with the plug-side housing 5 by insert molding.

Figure 20:
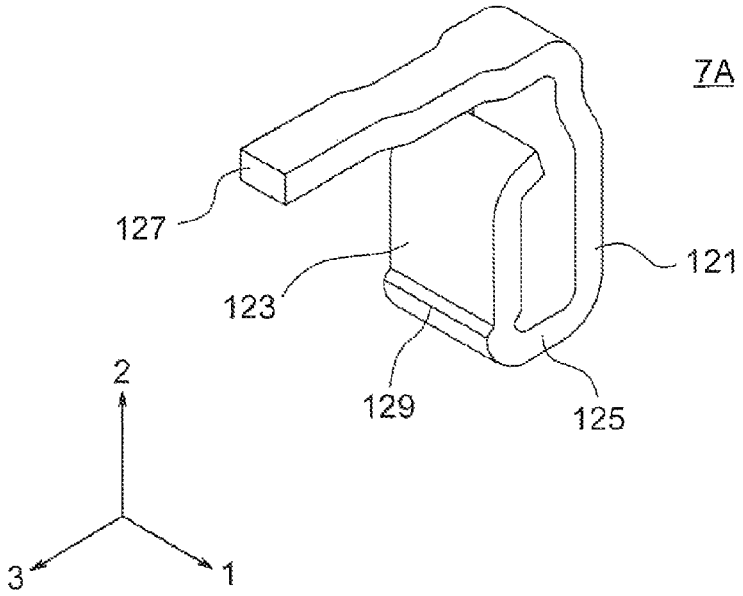
FIG. 20 is a perspective view of a plug-side signal contact 7A.

At this time, it is desired that the resin flow along the first direction 1 so as to easily flow into the space between the first flat surface portion 91 and the second flat surface portion 93 (FIG. 17), and into a space between the third flat surface portion 121 and the fourth flat surface portion 123 (FIG. 20).

However, when the distance D2 and the distance D4 are different from each other, the resin stagnates in the narrower distance, which may inhibit the resin from flowing.

Accordingly, it is desired that the distance D4 be equal to the distance D2.

Figure 18:
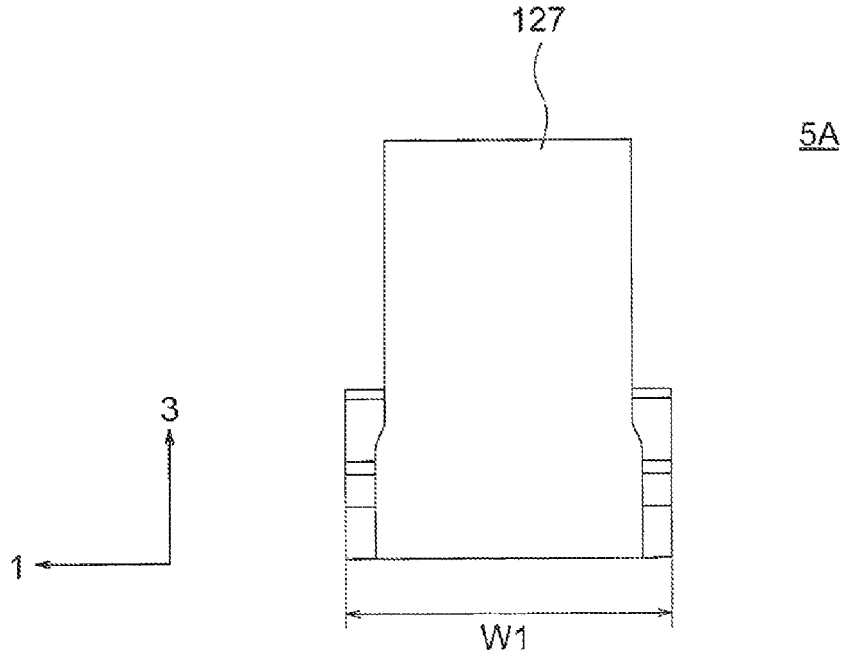
FIG. 18 is a plan view of the plug-side power contact 5A.
Figure 21:
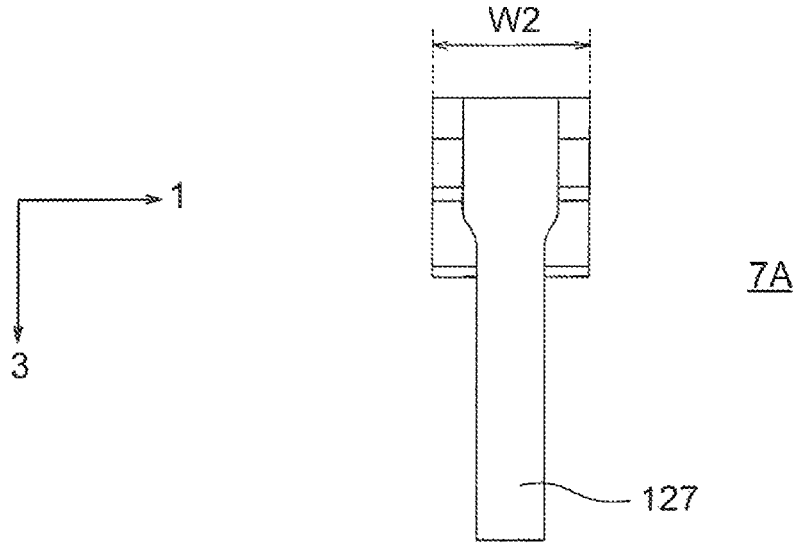
FIG. 21 is a plan view of the plug-side signal contact 7A.
Figure 22:
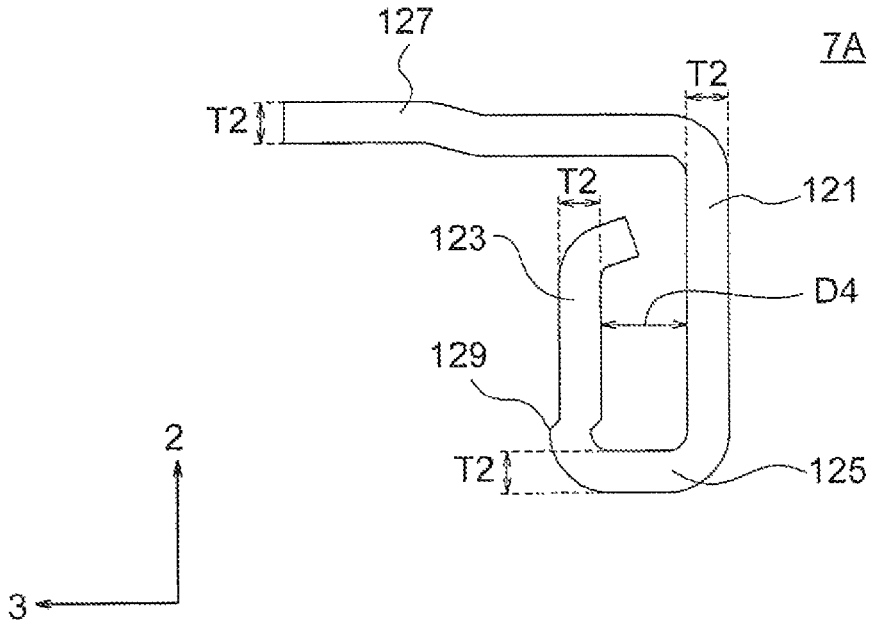
FIG. 22 is a side view of the plug-side signal contact 7A.
Figure 23:
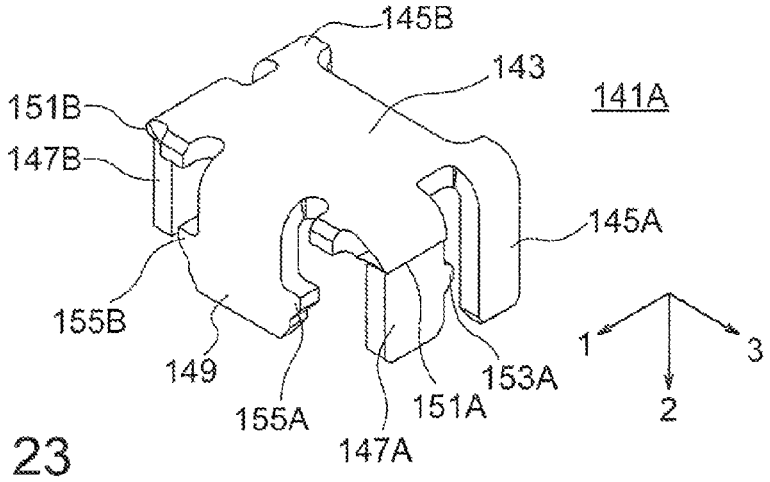
FIG. 23 is a perspective view of a plug-side reinforcing portion 141A.
Figure 24:
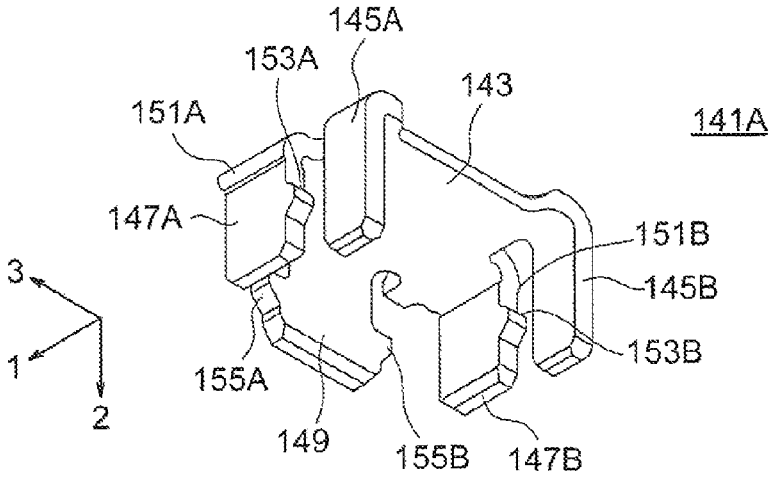
FIG. 24 is a perspective view of the plug-side reinforcing portion 141A when viewed from a direction different from that of FIG. 23.
Figure 25:
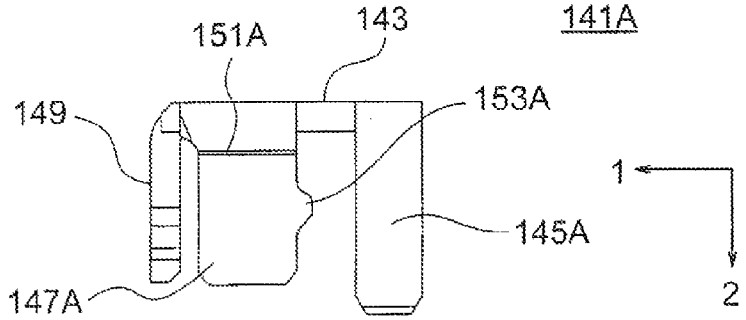
FIG. 25 is a side view of the plug-side reinforcing portion 141A.

Note that, as illustrated in FIG. 18 and FIG. 21, the width W1 (maximum width) of each of the plug-side power contacts 5A, 5B, 5C, and 5D along the first direction 1 (along the arraying direction) is larger than the width W2 (maximum width) of each of the plug-side signal contacts 7A and 7B along the first direction 1. This is because the plug-side power contacts 5A, 5B, 5C, and 5D have a role of conducting currents, thereby requiring a larger current carrying capacity than that of the plug-side signal contacts 7A and 7B.

As illustrated in FIG. 12 and FIG. 23 to FIG. 25, the plug-side reinforcing portion 141A includes a plug-side reinforcing body portion 143 having a plate-like shape conforming to the shape of the end portion of the plug-side housing 5 in plan view, and plug-side reinforcing leg portions 145A and 145B and plug-side reinforcing leg portions 147A and 147B protruding in the positive orientation of the second direction 2 from both ends of the plug-side reinforcing body portion 143 along the third direction 3 so as to be orthogonal to the plug-side reinforcing body portion 143. It is desired that the plug-side reinforcing portion 141A be made of a conductive material such as metal, but the material of the plug-side reinforcing portion 141A is not limited thereto.

In addition, the plug-side reinforcing portion 141A includes a plug-side reinforcing leg portion 149 protruding in the positive orientation of the second direction 2 from an end portion of the plug-side reinforcing body portion 143 on the positive orientation side of the first direction 1 so as to be orthogonal to the plug-side reinforcing body portion 143.

The plug-side reinforcing leg portions 147A and 147B respectively include band-like protruding portions 151A and 151B that protrude in the positive orientation and the negative orientation of the third direction 3, respectively, and are to be engaged with the protrusions 87A and 87B (see FIG. 14) of the receptacle-side reinforcing portion 10A or 10B.

Further, the plug-side reinforcing leg portions 147A and 147B respectively include protrusions 153A and 153B that protrude in the negative orientation of the first direction 1 and are to be used when the plug-side reinforcing leg portions 147A and 147B are press-fitted into the plug-side housing 5.

In addition, the plug-side reinforcing leg portion 149 includes protrusions 155A and 155B that are formed so as to protrude from both ends of the plug-side reinforcing leg portion 149 along the third direction 3, and are to be used when the plug-side reinforcing leg portion 149 is press-fitted into the plug-side housing 5.

Figure 6:
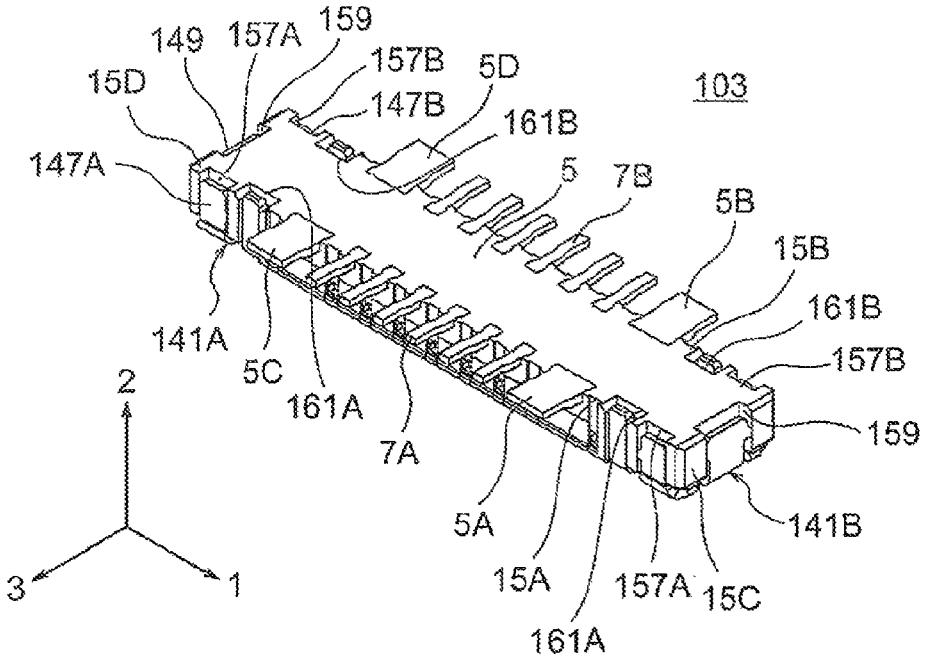
FIG. 6 is a perspective view of a plug connector 103.

With reference also to FIG. 6, the plug-side reinforcing leg portions 147A and 147B are respectively inserted into groove portions 157A and 157B respectively formed in the plug-side fitting portions 15A and 15B of the plug-side housing 5, and the plug-side reinforcing leg portions 145A and 145B are respectively inserted into groove portions 161A and 161B respectively formed in the plug-side fitting portions 15A and 15B of the plug-side housing 5. Further, the plug-side reinforcing leg portion 149 is inserted into a groove portion 159 formed in the plug-side coupling portion 15C or 15D. Thus, the plug-side reinforcing portion 141A is fixed to the plug-side housing 5.

Note that, the plug-side reinforcing portion 141B has the same structure as that of the plug-side reinforcing portion 141A. Accordingly, description thereof is omitted.

Figure 7:
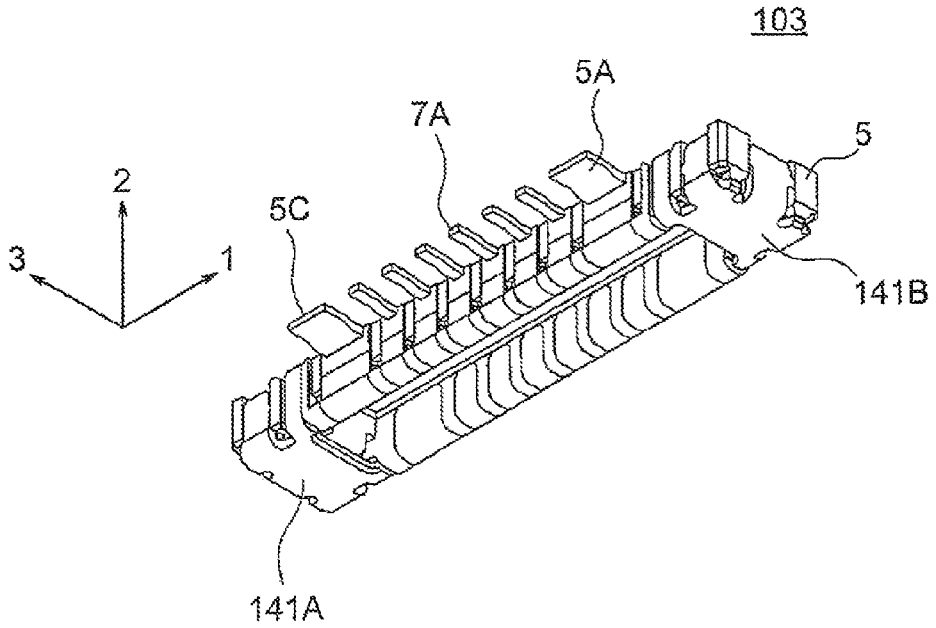
FIG. 7 is a perspective view of the plug connector 103 when viewed from a direction different from that of FIG. 6.
Figure 8:
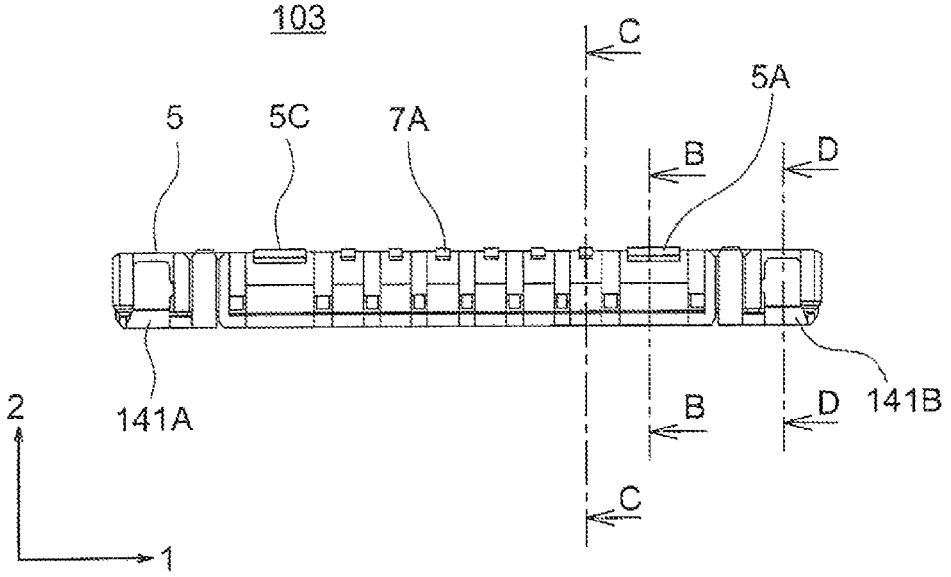
FIG. 8 is a side view of the plug connector 103.
Figure 9:
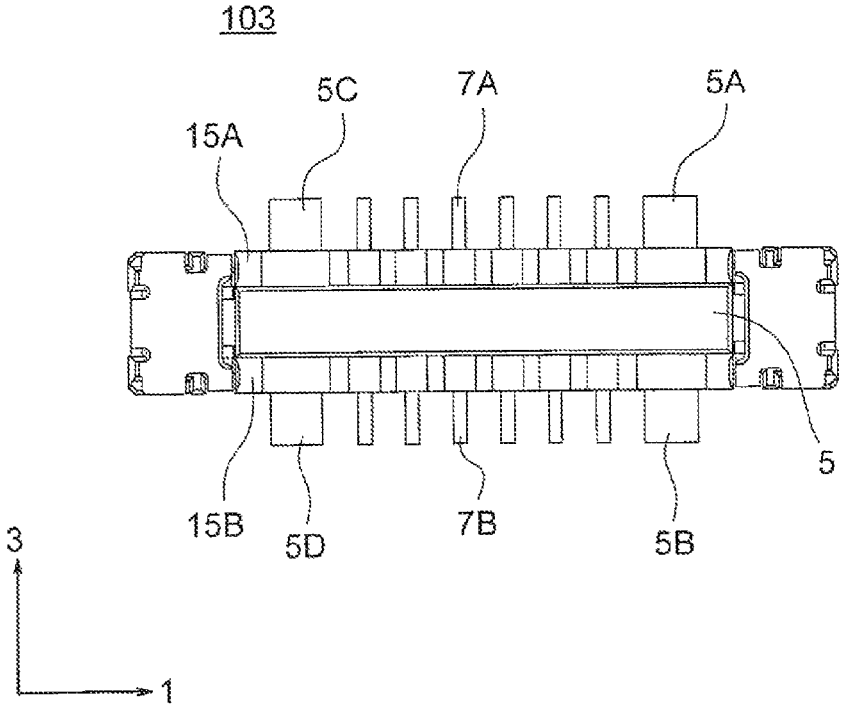
FIG. 9 is a bottom view of the plug connector 103.
Figure 10:
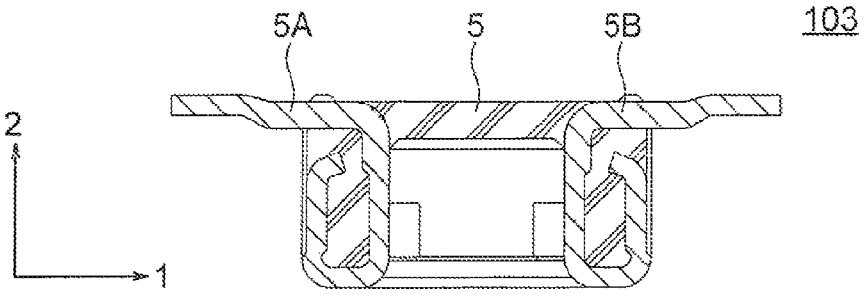
FIG. 10 is a cross-sectional view taken along the line B-B of FIG. 8.
Figure 11:
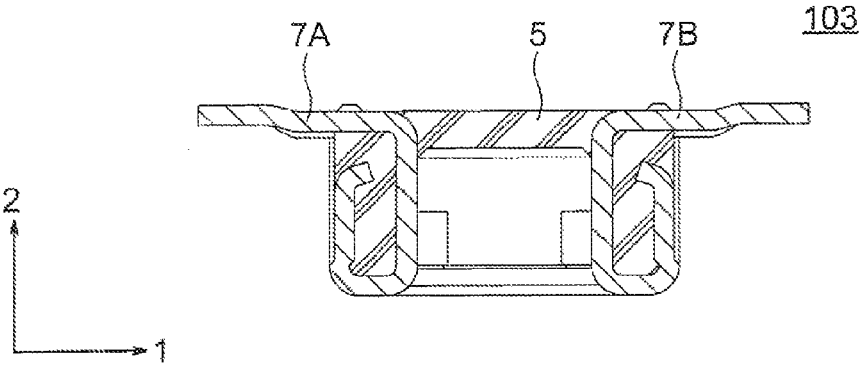
FIG. 11 is a cross-sectional view taken along the line C-C of FIG. 8.
Figure 12:
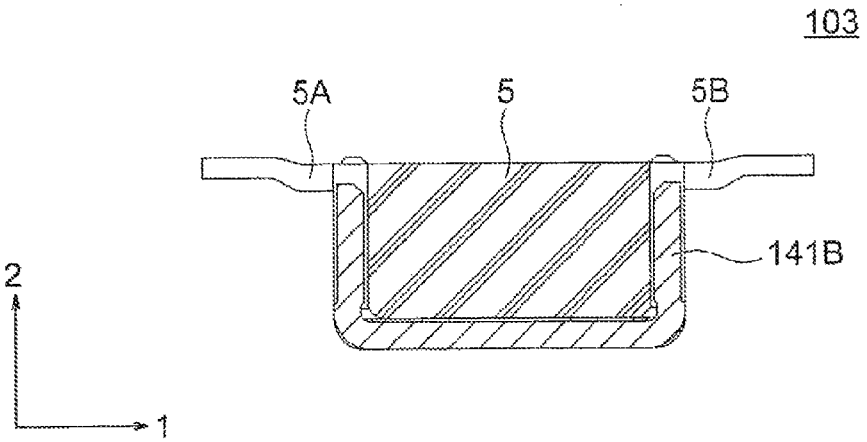
FIG. 12 is a cross-sectional view taken along the line D-D of FIG. 8.
Figure 13:
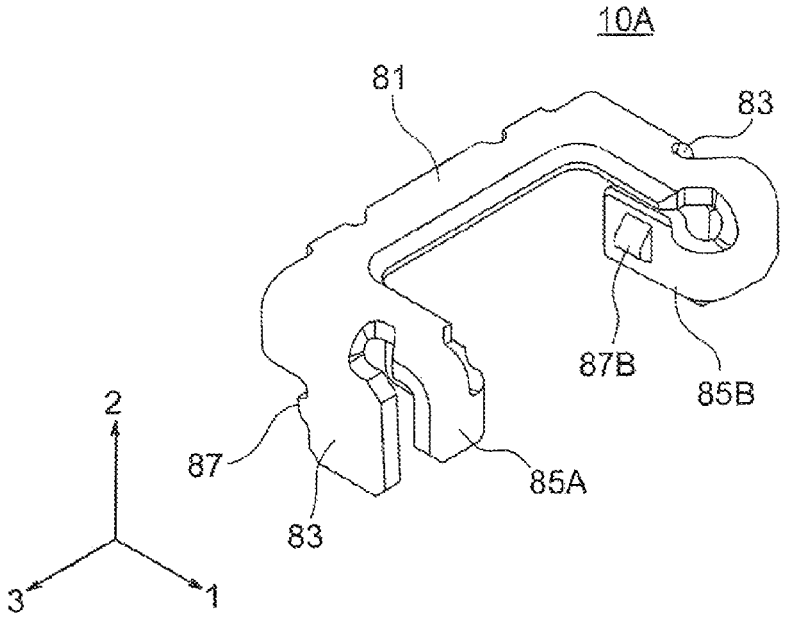
FIG. 13 is a perspective view of a receptacle-side reinforcing portion 10A.
Figure 14:
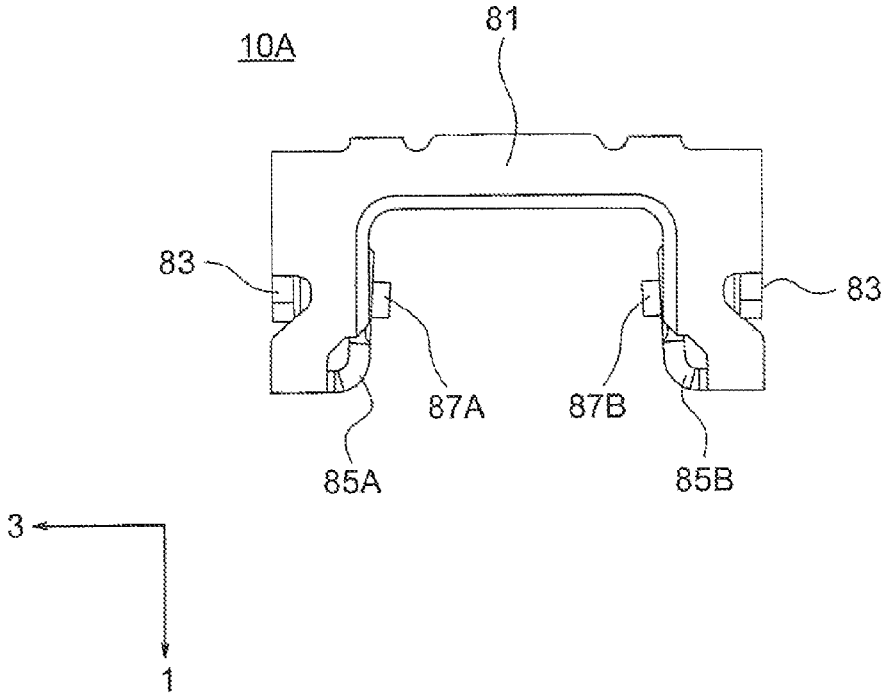
FIG. 14 is a plan view of the receptacle-side reinforcing portion 10A.
Figure 15:
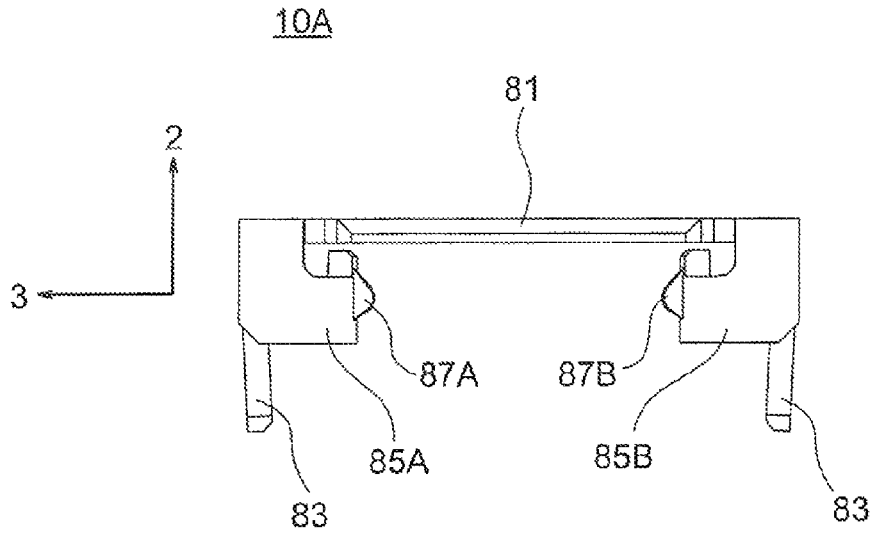
FIG. 15 is a front view of the receptacle-side reinforcing portion 10A.
Figure 16:
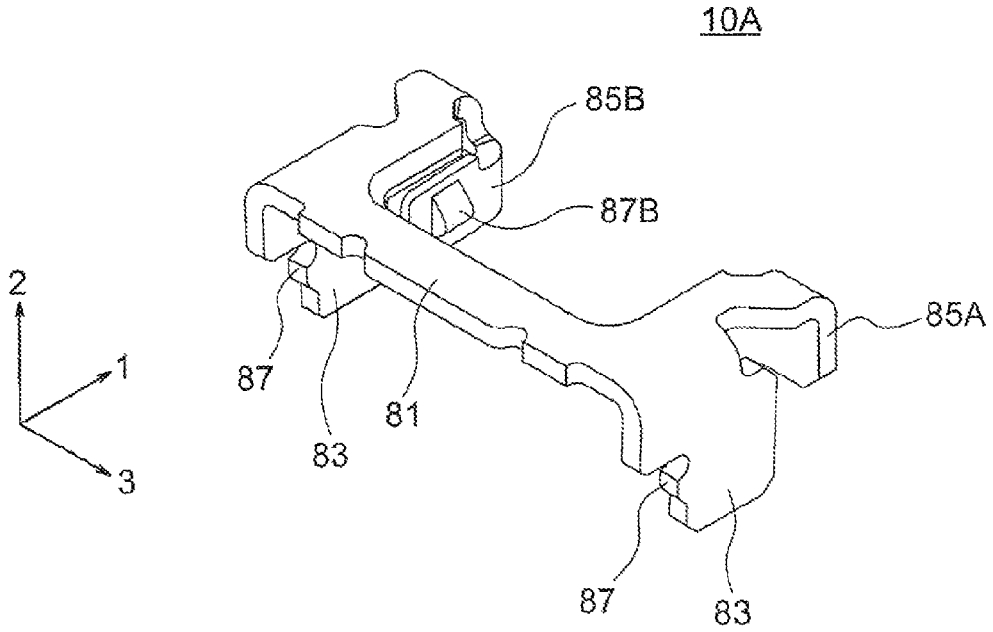
FIG. 16 is a perspective view of the receptacle-side reinforcing portion 10A when viewed from a direction different from that of FIG. 13.
Figure 17:
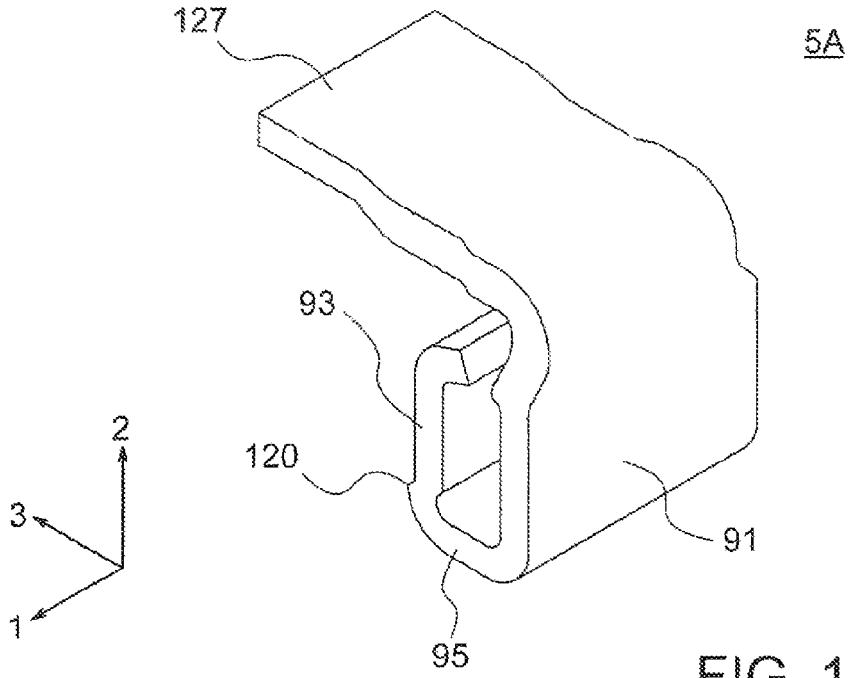
FIG. 17 is a perspective view of a plug-side power contact 5A.

Further, the plug-side reinforcing portion 141A and the plug-side reinforcing portion 141B are arranged at both ends of the plug-side housing 5 along the first direction 1, respectively (see FIG. 7). Similarly, the receptacle-side reinforcing portions 10A and 10B are arranged at both ends of the receptacle-side housing 9 along the first direction 1, respectively (see FIG. 4). The plug-side reinforcing portions 141A and 141B and the receptacle-side reinforcing portions 10A and 10B are arranged at the above-mentioned positions, thereby being capable of increasing strength of the plug connector 103 in the arraying direction of the plug-side signal contacts 7A and 7B (along the first direction 1).

The shape of the plug connector 103 is described above.

Next, procedures of combining the plug connector 103 and the receptacle connector 101 into the board-to-board connector assembly 100 are briefly described with reference to FIG. 3 and FIG. 26.

Figure 26:
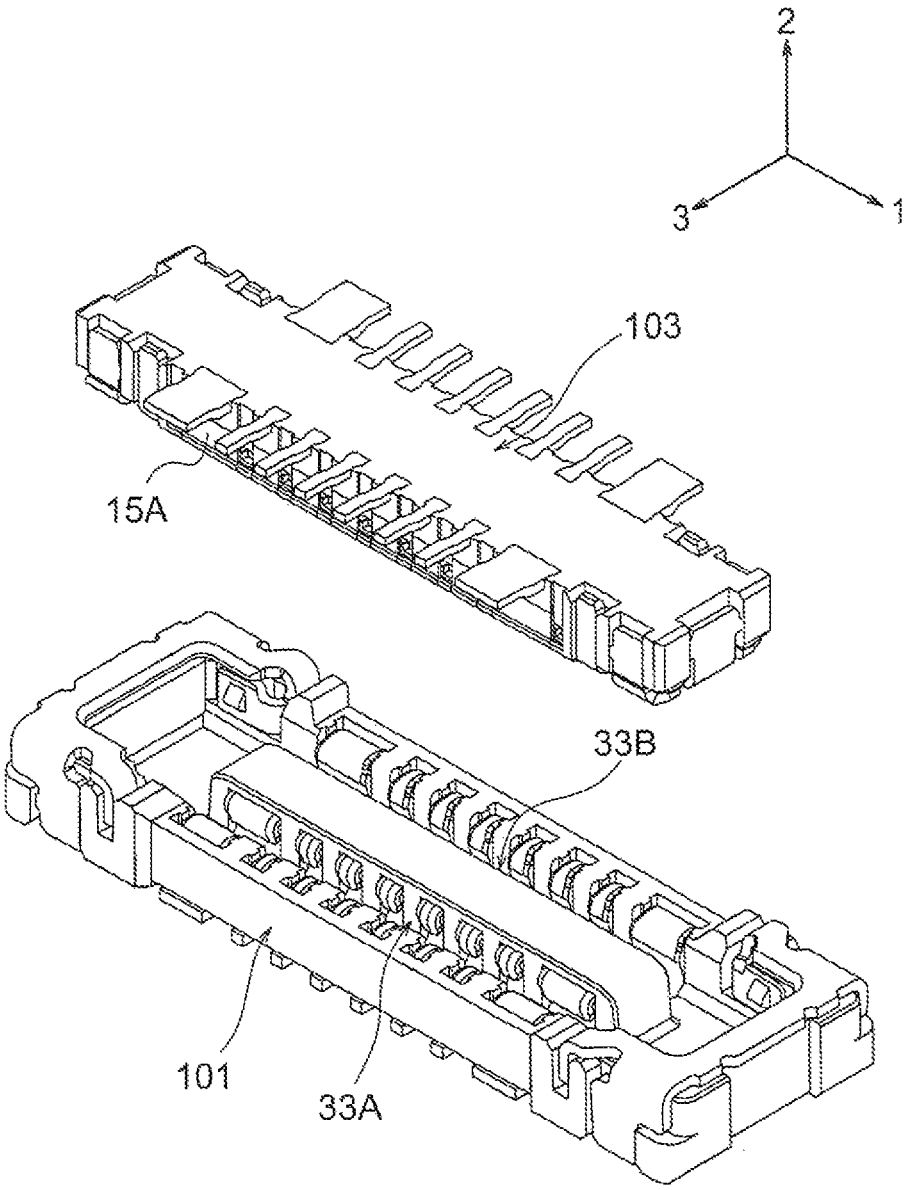
FIG. 26 is a perspective view for illustrating procedures when combining the plug connector 103 and the receptacle connector 101 together.
Figure 27:
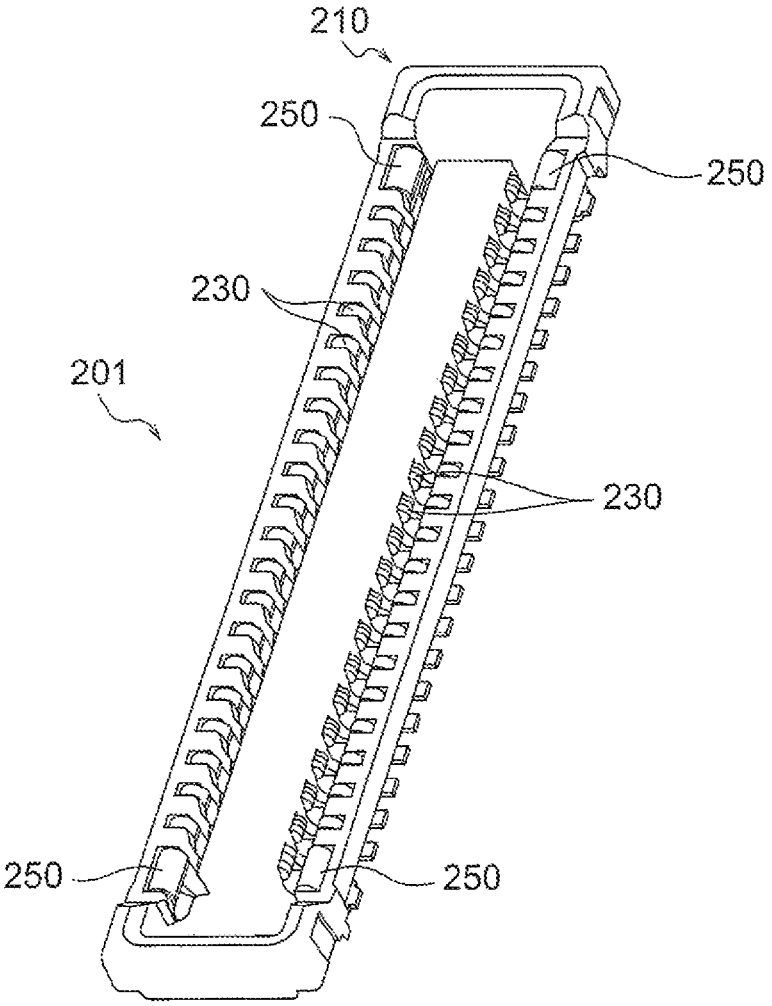
FIG. 27 is a perspective view of a related-art receptacle connector 201.
Figure 28:
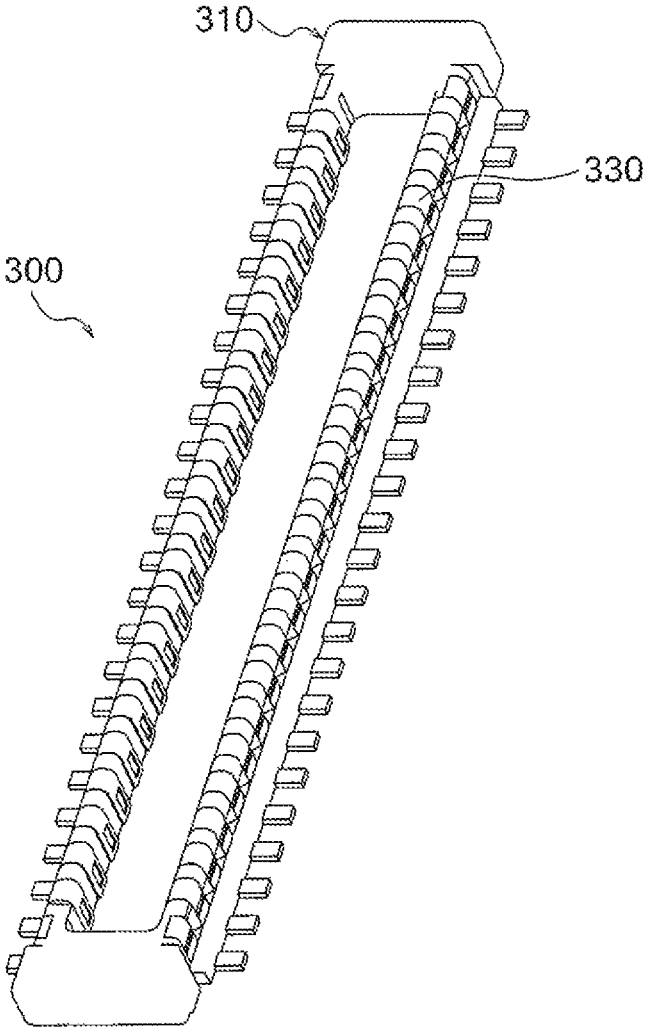
FIG. 28 is a perspective view of a related-art plug connector 300.

First, as illustrated in FIG. 26, the recessed portions 33A and 33B of the receptacle connector 101 are aligned with the plug-side fitting portions 15A and 15B of the plug connector 103 along the first direction 1 and the third direction 3, respectively, and the plug-side fitting portions 15A and 15B are inserted into the recessed portions 33A and 33B, respectively.

At this time, as illustrated in FIG. 3, the plug-side power contacts 5A and 5B and the plug-side power contacts 5C and 5D (not shown) are brought into contact with the ends of the C-shaped cross-sections of the receptacle-side power contacts 12A and 12B and the receptacle-side power contacts 12C and 12D (not shown) of the receptacle connector 101, thereby pressing the receptacle-side power contacts 12A and 12B and the receptacle-side power contacts 12C and 12D.

In this manner, the receptacle-side power contacts 12A and 12B and the receptacle-side power contacts 12C and 12D are elastically deformed so as to increase a distance between the both ends of the C-shaped cross-section of each of the receptacle-side power contacts. Thus, engagement between the plug-side power contacts 5A and 5B and the receptacle-side power contacts 12A and 12B, and engagement between the plug-side power contacts 5C and 5D and the receptacle-side power contacts 12C and 12D are completed.

In this state, the plug-side power contacts 5A and 5B and the plug-side power contacts 5C and 5D of the plug connector 103 are nipped in the receptacle-side power contacts 12A and 12B and the receptacle-side power contacts 12C and 12D of the receptacle connector 101 so that the plug-side power contacts and the receptacle-side power contacts are electrically connected to each other.

Note that, connection between the receptacle-side signal contacts 11A and 11B and the plug-side signal contacts 7A and 7B is established similarly to the connection between the receptacle-side power contacts 12A and 12B and the plug-side power contacts 5A and 5B. Accordingly, description thereof is omitted.

Similarly, the protruding portions 151A and 151B of the plug-side reinforcing leg portions 147A and 147B (FIG. 23) are brought into contact with the protrusions 87A and 87B of the receptacle-side reinforcing coupling portions 85A and 85B (see FIG. 15), respectively, and are engaged with the protrusions 87A and 87B so as to increase a distance between the receptacle-side reinforcing coupling portions 85A and 85B.

In this manner, the receptacle-side reinforcing portions 10A and 10B and the plug-side reinforcing portions 141A and 141B are also electrically connected to each other.

In this state, the receptacle-side signal contacts 11A and 11B and the plug-side signal contacts 7A and 7B have a role of transmitting signals.

On the other hand, the receptacle-side power contacts 12A, 12B, 12C, and 12D and the plug-side power contacts 5A, 5B, 5C, and 5D have a role of conducting power currents.

In addition, the receptacle-side reinforcing portions 10A and 10B are held in contact with the plug-side reinforcing portions 141A and 141B, respectively, and the receptacle-side reinforcing portions 10A and 10B and the plug-side reinforcing portions 141A and 141B have a role of conducting power currents.

As described above, in the board-to-board connector assembly 100, not only the receptacle-side power contacts 12A, 12B, 12C, and 12D and the plug-side power contacts 5A, 5B, 5C, and 5D, but also the receptacle-side reinforcing portions 10A and 10B and the plug-side reinforcing portions 141A and 141B have a role of conducting power currents (are to be used for conduction of power).

Accordingly, the power currents can be divided between the reinforcing portions and the power contacts. Thus, it is possible to reduce loads of the currents applied to the receptacle-side power contacts 12A, 12B, 12C, and 12D and the plug-side power contacts 5A, 5B, 5C, and 5D.

Further, the receptacle-side reinforcing portions 10A and 10B and the plug-side reinforcing portions 141A and 141B function as power contacts utilizing the reinforcing portions. Accordingly, it is possible to divide the power currents without increasing the number of power contacts and dimensions of the power contacts.

The procedures of combining the plug connector 103 and the receptacle connector 101 together are described above.

As described above, according to this embodiment, the board-to-board connector assembly 100 includes the receptacle connector 101 and the plug connector 103. The receptacle connector 101 includes the receptacle-side housing 9 including the insular portion 37 having long sides along the first direction 1 and extending along the second direction 2 orthogonal to the first direction 1, and the receptacle-side long wall portions 31A and 31B formed so that the recessed portion 33A is formed between the insular portion 37 and the receptacle-side long wall portion 31A and the recessed portion 33B is formed between the insular portion 37 and the receptacle-side long wall portion 31B along the third direction 3 orthogonal to the first direction 1 and the second direction 2. The receptacle connector 101 further includes the receptacle-side signal contacts 11A each including the contact portions 20A and 20B, and the receptacle-side signal contacts 11B each including the contact portions 20C and 20D. The receptacle-side signal contacts 11A and 11B are retained in the receptacle-side housing 9 so that the contact portions are exposed to insides of the recessed portions 33A and 33B. The receptacle connector 101 further includes the receptacle-side power contacts 12A, 12B, 12C, and 12D retained in the receptacle-side housing 9 so as to be arrayed together with the receptacle-side signal contacts 11A and 11B along the first direction 1. The plug connector 103 includes the plug-side housing 5 including the plug-side fitting portions 15A and 15B to be respectively inserted into the recessed portions 33A and 33B, the plug-side signal contacts 7A and 7B retained in the plug-side housing 5 so as to be exposed to outsides of the plug-side fitting portions 15A and 15B, and the plug-side power contacts 5A, 5B, 5C, and 5D that are retained in the plug-side housing 5 so as to be exposed to outsides of the plug-side fitting portions 15A and 15B, and are to be brought into contact with the receptacle-side power contacts 12A, 12B, 12C, and 12D, respectively. Each of the plug-side power contacts 5A, 5B, 5C, and 5D includes the first flat surface portion 91 having a plate-like shape and being parallel to the first direction 1 and the second direction 2, the second flat surface portion 93 having a plate-like shape and being opposed to a part of the first flat surface portion 91 through intermediation of a component (made of, for example, a resin in this case) of the plug-side housing 5, and the power-contact-side connection portion 95 formed in parallel to the third direction 3 and the first direction 1 and configured to connect the first flat surface portion 91 and the second flat surface portion 93 to each other. The first flat surface portion 91 includes the stepped portion 115 between a surface opposed in parallel to a surface of the second flat surface portion 93 on the first flat surface portion 91 side, and a surface except for the surface opposed in parallel to the surface of the second flat surface portion 93 on the first flat surface portion 91 side, and includes the thinned portion 113 that corresponds to a portion having the surface opposed in parallel to the surface of the second flat surface portion 93 on the first flat surface portion 91 side, and has a smaller thickness along the third direction 3 than a thickness of the upper end portion 99 having the surface except for the surface opposed in parallel to the surface of the second flat surface portion 93 on the first flat surface portion 91 side.

Accordingly, the board-to-board connector assembly 100 can ensure both the current carrying capacity and moldability.

This invention is described above with reference to the above-mentioned embodiment, but this invention is not limited to the above-mentioned embodiment.

It is apparent that a person skilled in the art can conceive a variety of modifications and improvements within the technical scope of this invention, and the modifications and the improvements may be understood as being encompassed within the scope of this invention.

What is claimed is:

1. A board-to-board connector assembly, comprising:

a receptacle connector comprising:

a receptacle-side housing comprising:

an insular portion having long sides along a first direction and extending along a second direction orthogonal to the first direction; and receptacle-side long wall portions formed so that a recessed portion is formed between the insular portion and each of the receptacle-side long wall portions along a third direction orthogonal to both of the first direction and the second direction;

a receptacle-side signal contact comprising a contact portion, the receptacle-side signal contact being retained in the receptacle-side housing so that the contact portion is exposed to an inside of the recessed portion; and a receptacle-side power contact, which is retained in the receptacle-side housing so as to be arrayed together with the receptacle-side signal contact along the first direction; and a plug connector comprising:

a plug-side housing comprising a projecting portion to be inserted into the recessed portion;

a plug-side signal contact, which is retained in the plug-side housing so as to be exposed to an outside of the projecting portion; and a plug-side power contact, which is retained in the plug-side housing so as to be exposed to the outside of the projecting portion, and is to be brought into contact with the receptacle-side power contact, the plug-side power contact comprising:

a first flat surface portion having a plate-like shape and being parallel to the first direction and the second direction;

a second flat surface portion having a plate-like shape and being opposed to a part of the first flat surface portion through intermediation of a component of the plug-side housing; and a power-contact-side connection portion formed in parallel to the third direction and the first direction and configured to connect the first flat surface portion and the second flat surface portion to each other, at least one of the first flat surface portion and the second flat surface portion comprising:

a stepped portion between a surface opposed in parallel to a surface of another one of the first flat surface portion and the second flat surface portion, and a surface except for the surface opposed in parallel to the surface of the another one of the first flat surface portion and the second flat surface portion; and a thinned portion that corresponds to a portion having the surface opposed in parallel to the surface of the another one of the first flat surface portion and the second flat surface portion, and has a smaller thickness along the third direction than a thickness of a portion having the surface except for the surface opposed in parallel to the surface of the another one of the first flat surface portion and the second flat surface portion.

2. A board-to-board connector assembly according to claim 1, wherein the plug-side signal contact comprises:

a third flat surface portion having a plate-like shape and being parallel to the first direction and the second direction;

a fourth flat surface portion having a plate-like shape and being opposed to a part of the third flat surface portion through intermediation of the component of the plug-side housing; and a signal-contact-side connection portion formed in parallel to the third direction and the first direction and configured to connect the third flat surface portion and the fourth flat surface portion to each other, and wherein a distance along the third direction between an inner side of the third flat surface portion and an inner side of the fourth flat surface portion is equal to a distance along the third direction between the first flat surface portion and the second flat surface portion at a position between an inner side of the thinned portion and an inner side of one of the first flat surface portion and the second flat surface portion opposed to the thinned portion.

3. A board-to-board connector assembly according to claim 1, wherein the plug-side power contact is arranged on an end portion side of the plug-side housing along the first direction with respect to the plug-side signal contact, and wherein the receptacle-side power contact is arranged on an end portion side of the receptacle-side housing along the first direction with respect to the receptacle-side signal contact.

4. A board-to-board connector assembly according to claim 1, wherein the plug-side housing further comprises a plug-side reinforcing portion arranged on the end portion side of the plug-side housing along the first direction with respect to the plug-side power contact, and wherein the receptacle-side housing further comprises a receptacle-side reinforcing portion arranged on the end portion side of the receptacle-side housing along the first direction with respect to the receptacle-side power contact.

5. A board-to-board connector assembly according to claim 4, wherein the plug-side reinforcing portion and the receptacle-side reinforcing portion are to be used for conduction of power through contact with each other under a state in which the plug connector and the receptacle connector are fitted to each other.

6. A board-to-board connector assembly according to claim 4, wherein the plug-side reinforcing portion is arranged on each end of the plug-side housing along the first direction, and wherein the receptacle-side reinforcing portion is arranged on each end of the receptacle-side housing along the first direction.

7. A board-to-board connector assembly according to claim 1, wherein the plug-side power contacts equally arranged at four positions on the plug-side housing, and wherein the receptacle-side power contacts are equally arranged at four positions on the receptacle-side housing.

8. A board-to-board connector assembly according to claim 1, wherein the plug-side power contact is wider than the plug-side signal contact along the first direction, and wherein the receptacle-side power contact is wider than the receptacle-side signal contact along the first direction.

9. A connector, comprising:

a plug-side housing, which has long sides along a first direction, the plug-side housing comprising a plug-side fitting portion extending along a second direction orthogonal to the first direction;

a plug-side signal contact, which is retained in the plug-side housing so as to be exposed to an outside of the plug-side fitting portion; and a plug-side power contact, which is retained in the plug-side housing so as to be exposed to the outside of the plug-side fitting portion, the plug-side power contact comprising:

a first flat surface portion having a plate-like shape and being parallel to the first direction and the second direction;

a second flat surface portion having a plate-like shape and being opposed to a part of the first flat surface portion through intermediation of a component of the plug-side housing; and a power-contact-side connection portion formed in parallel to the first direction and a third direction orthogonal to the first direction and the second direction, and configured to connect the first flat surface portion and the second flat surface portion to each other, at least one of the first flat surface portion and the second flat surface portion comprising:

a stepped portion between a surface opposed in parallel to a surface of another one of the first flat surface portion and the second flat surface portion, and a surface except for the surface opposed in parallel to the surface of the another one of the first flat surface portion and the second flat surface portion; and a thinned portion that corresponds to a portion having the surface opposed in parallel to the surface of the another one of the first flat surface portion and the second flat surface portion, and has a smaller thickness along the third direction than a thickness of a portion having the surface except for the surface opposed in parallel to the surface of the another one of the first flat surface portion and the second flat surface portion.

10. A connector according to claim 9, wherein the plug-side signal contact comprises:

a third flat surface portion having a plate-like shape and being parallel to the first direction and the second direction;

a fourth flat surface portion having a plate-like shape and being opposed to a part of the third flat surface portion through intermediation of the component of the plug-side housing; and a signal-contact-side connection portion formed in parallel to the third direction and the first direction and configured to connect the third flat surface portion and the fourth flat surface portion to each other, and wherein a distance along the third direction between an inner side of the third flat surface portion and an inner side of the fourth flat surface portion is equal to a distance along the third direction between the first flat surface portion and the second flat surface portion at a position between an inner side of the thinned portion and an inner side of one of the first flat surface portion and the second flat surface portion opposed to the thinned portion.

11. A connector according to claim 9, wherein the plug-side power contact is arranged on an end portion side of the plug-side housing along the first direction with respect to the plug-side signal contact.

12. A connector according to claim 9, wherein the plug-side housing further comprises a plug-side reinforcing portion arranged on the end portion side of the plug-side housing along the first direction with respect to the plug-side power contact.

13. A connector according to claim 12, wherein the plug-side reinforcing portion is to be used for conduction of power.

14. A connector according to claim 12, wherein the plug-side reinforcing portion is arranged on each end of the plug-side housing along the first direction.

15. A connector according to claim 9, wherein the plug-side power contacts are equally arranged at four positions on the plug-side housing.

16. A connector according to claim 9, wherein the plug-side power contact is wider than the plug-side signal contact along the first direction.

* * * * *